United States Patent [19]

Chiu

[11] Patent Number: 4,705,601

[45] Date of Patent: Nov. 10, 1987

[54] MULTI-PLY PAPER FORMING FABRIC WITH OVATE WARP YARNS IN LOWERMOST PLY

[75] Inventor: Kai F. Chiu, Brandon, Miss.

[73] Assignee: B.I. Industries, Inc., Florence, Miss.

[21] Appl. No.: 11,008

[22] Filed: Feb. 5, 1987

[51] Int. Cl.[4] ..... D21F 1/10; D21F 7/08; D03D 15/00

[52] U.S. Cl. ..... 162/348; 139/425 A; 139/383 A; 162/DIG. 1

[58] Field of Search ..... 162/DIG. 1, 348; 139/408–413, 383 A, 425 A

[56] References Cited

U.S. PATENT DOCUMENTS

| | | | |
|---|---|---|---|
| 3,885,602 | 5/1975 | Slaughter | 139/425 A |
| 3,885,603 | 5/1975 | Slaughter | 139/425 A |
| 4,142,557 | 3/1979 | Kositzke | 139/425 A |
| 4,414,263 | 11/1983 | Miller et al. | 162/DIG. 1 |
| 4,438,788 | 3/1984 | Harwood | 162/DIG. 1 |
| 4,467,839 | 8/1984 | Westhead | 139/383 A |

*Primary Examiner*—S. Leon Bashore

*Assistant Examiner*—K. M. Hastings

*Attorney, Agent, or Firm*—Dann, Dorfman, Herrell and Skillman

[57] ABSTRACT

A wire former comprising a structural framework, a headbox for holding and dispensing the pulp slurry, a breast roll, a couch roll, a forming fabric belt extending endless between the breast roll and the couch roll in a straight run, and drainage elements and suction devices underlying said straight run for extracting liquid from the slurry. The forming fabric is a multi-ply fabric, the uppermost ply being a self-sustaining weave with monofilament warp yarns of a given diameter interwoven with shute yarns, the lowermost ply being a weave with a series of generally ovate warp yarns having a vertical dimension generally equal to the diameter of the warp yarns of the uppermost ply, interwoven with shute yarns. The ovate warp yarns have a horizontal width in the shute direction substantially greater than their vertical dimension. Binder shute yarns interconnect the upper and lower plies by being interwoven with the upper and lower plies so as to be contained within the body of the multi-ply fabric.

5 Claims, 4 Drawing Figures

MULTI-PLY PAPER FORMING FABRIC WITH OVATE WARP YARNS IN LOWERMOST PLY

FIELD OF THE INVENTION

The present invention relates to fabrics employed to support the paper in a paper-making machine and is particularly directed to a multi-ply forming fabric used at the wet end of the paper-making machine.

BACKGROUND OF THE INVENTION

In recent years the conventional wires used at the wet end of a Fourdrinier paper-making machine have been replaced by fabrics made of synthetic polymers, normally monofilament yarns arranged in a weaving pattern that produces sufficient porosity to afford extraction of large quantities of water from the pulp deposited on the forming fabric for ultimate formation into the paper web. Apart from the ability of the forming fabric to afford extraction of free water from the pulp, it has been found that it is desirable to provide differing surface characteristics on the opposite surfaces of the forming fabric so that the pulp side of the forming fabric does not adversely affect the characteristics of the paper web formed on the fabric, and the machine side of the fabric is provided with characteristics which improve the wear-resistance as the web is trained about the guide rolls and across the dewatering boxes at the wet end of the paper-making machine.

To achieve these results, it has been found desirable to provide a multi-ply forming fabric having differing surface characteristics on the pulp side and the machine side respectively. For example, a so-called "triple layer" fabric is commonly used which has a self-sustaining fabric as the top ply, the ply exhibiting a 1×1 plain weave of polyester yarns with a diameter of 0.007", a bottom ply consisting of a self sustaining fabric of a plain weave polyester yarn having a 1×1 weave pattern, for example polyester monofilaments having a diameter of 0.015". The top and bottom plies are interconnected by a binder having a diameter of 0.004" which follows a 1×7 path through the top ply and a 3×1 path through the bottom ply. In use, it has been found that this fabric exhibits substantial wear-resistance in the bottom ply, as would be anticipated, but it has also been found that the fabric after becoming worn may tend to delaminate due to internal localized wear of the binder causing irregularities in the fabric which adversely affect the paper web which is formed on the worn fabric.

The so-called "triple-layer" fabric of the prior art exhibits good mechanical stability as it travels in the forming section of the paper machine and maintains production of the desired surface characteristics in the web throughout its useful life, but the increased stability limits the "table activity" which jostles the pulp on the wire to enhance the uniform and smooth surface texture in the paper produced by the machine.

SUMMARY OF THE INYENTION

With the foregoing in mind, the present invention provides a multi-ply forming fabric for a paper machine which exhibits improved wear characteristics without impairing the surface characteristics of the upper and lower plies.

More specifically, the present invention provides a multi-ply fabric in which the weave pattern permits the use of warp yarns in the top ply providing a preselected surface characteristic in the paper web formed on the forming fabric and at the same time warp yarns in the lower ply providing the desired porosity in the multi-ply fabric and the desired wear resistance in the fabric.

More specifically, the present invention provides a multi-ply fabric having warp yarns of approximately the same vertical dimension in the upper and lower plies, but with yarns of greater horizontal width in the lower ply, the plies being interconnected by binder yarns interwoven with the plies in a manner to minimize the tendency of these plies to delaminate after prolonged use.

The fabric of the present invention has good dimensional stability in the direction of the warp and the shute, but also exhibits increased flexibility in the warp direction in comparison to the conventional fabric which affords "table activity" which enhances the characteristics of the paper produced by the machine.

It has also been found that the present invention reduces the quantity of water which is entrapped in the fabric as it travels in the forming section of the machine, thereby increasing the amount of water which is removed from the pulp in the forming section and avoiding the tendency of the drier pulp at the exit end of the forming section becoming rewetted from the water entrained in the body of the fabric.

BRIEF DESCRIPTION OF THE DRAWINGS

All of the objects of the invention are more fully set forth hereinafter with reference to the accompanying drawings wherein.

DESCRIPTION OF A PREFERRED EMBODIMENT

Figure 1:
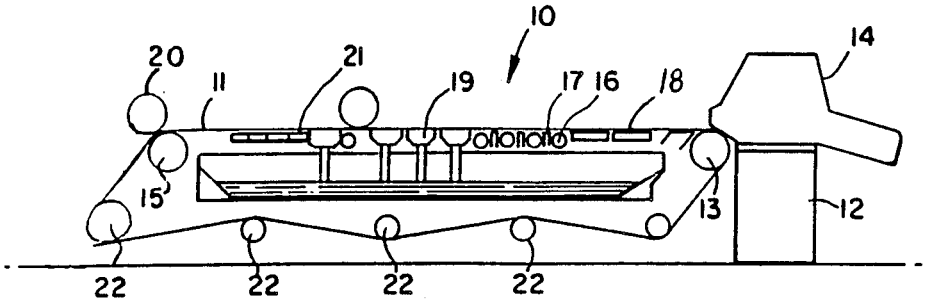
FIG. 1 is a diagrammatic view of the forming section of a paper-making machine embodying a forming fabric made in accordance with the present invention.

Referring now to the drawings and in particular to FIG. 1 thereof, there is diagrammatically illustrated the configuration of a typical papermaking machine in the forming section. A forming section includes a wire former, also referred to as the fourdrinier wire section, indicated generally by reference number 10. Other forming machines may include suction breast roll formers, cylinder machines, twin wire formers and variations thereof, but the following description is particularly directed to a wire former, it being understood that the fabric of this invention may be used in any paper-making wet process in which an endless belt comprising a major proportion by weight of synthetic (e.g. polyester) filament, is used for receiving a pulp slurry. The wire former 10 is so called because the paper-forming fibers in the pulp slurry are deposited on top of an endless forming fabric belt 11 running horizontally, with drainage elements positioned under the horizontal upper run of the fabric belt. Though it will be evident that the pulp slurry is a "pulp and water mixture", the latter term is also used to define the wet web from the time it commences to form on the fabric belt, to the time when the wet web passes through the press section, so as to encompass the wide range of proportions by weight of pulp and water from the front end of the wet section and the back of the press section.

The wire former comprises a rigid structural framework a portion of which includes large side beams 12 for the support of the elements defining the run of the belt. A large turning roll 13 underneath a headbox 14 holding and dispensing the pulp slurry at the front end of the former, has a wrap of about 180° and is called the breast roll. The roll 15 at the far end of the wire section is called the couch. The top part of the belt between the breast roll 13 and the couch 15 runs in a straight, mostly horizontal run over different types of drainage elements and supporting structures which are identified as suction devices conventional in paper-forming apparatus.

Among the suction devices used there are typically included plain or grooved table rolls 16, single or double deflectors 17, foils (18), wet suction boxes 19, and/or dry suction boxes 21, and a lump breaker roll 20 over the couch. As the name implies, the lump breaker breaks lumps of pulp and smooths out the pulp and water mixture on the belt by exerting pressure pulses on the mixture. Suction pulses are applied to the mixture as it passes over the suction boxes to accelerate the removal of water. Thus, in the forming machine, the pulp and water mixture is subjected to both suction and pressure pulses. It will be apparent that water will be removed even if the mixture is not subjected to suction pulses, but very slowly. Between the couch 15 and the breast roll 13 on the lower part of the wire belt, there are return rolls 22 to drive, support, stretch, and guide the belts.

Figure 2:
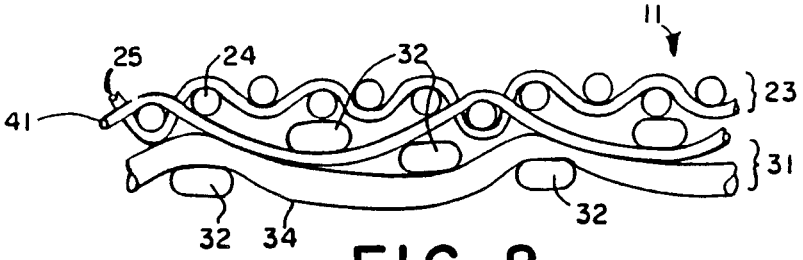
FIG. 2 is a shute-wise cross-section through the forming fabric of FIG. 1.
Figure 4:
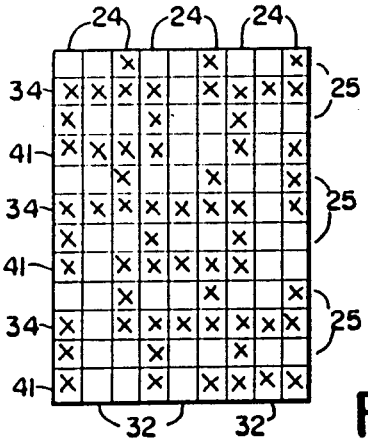
FIG. 4 is a weave diagram of the fabric of FIG. 2.
Figure 3:
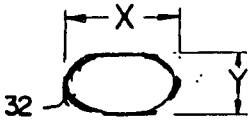
FIG. 3 is an enlarged cross-section through a bottom warp of the fabric shown in FIG. 2.

With reference to FIGS. 2–4, it is noted that the fabric belt 11 of the present invention comprises an upper ply 23 having warps 24, preferably tensioned so as to provide a smooth upper face when woven 1×1 with the shute yarns 25. The lower ply 31 has warps 32 arranged to cooperate with shute yarns 34 in a 1×2 weave. The two plies 23 and 31 are bound together by binder shutes 41, which in the present instance follow the path shown in FIGS. 2 and 4. Preferably, the upper shute yarns 25 are of comparable diameter to the upper warp yarns 24, and the lower shute yarns 34 are approximately twice the diameter of the upper shute yarns 25, and the binder shute 41 is equal to or smaller than the upper shute yarn 25. In any event, the binder passes over at least one warp 24 in the upper ply and under at least one warp 32 in the lower ply, preferably in a manner such that the binder yarn 41 is buried in the body of the multi-ply fabric and does not have any substantial exposure on either the upper pulp face or the lower machine face of the multi-ply fabric.

As shown in FIG. 3, the cross-section of the warp is ovate in form having a horizontal axis X which is in the range 1.5–2.5 times the length of the vertical axis Y. The length of the vertical axis of the bottom warp 32 is in the range of 1.0 to 1.5 times the diameter of the upper warps 24 so that the thickness of the upper and lower plies 23 and 31, respectively, are approximately equal. For example, if the diameter of the upper warps is one length unit, then the bottom layer warp vertical axis would be between 1.0 and 1.5 units in height and the horizontal axis would be in the range of 1.5–2.5 units in width.

FIG. 4 illustrates the weave diagram for the fabric of FIG. 2 and it is noted that the warp density of the yarns 24 in the upper ply 23 is substantially greater than the warp density of the yarns 32 in the lower ply 31, thereby providing a more dense surface confronting the pulp deposited on the fabric. The upper ply 23 is a single-layer construction with a weave pattern which repeats on 6 sheds, and the lower ply 31 is a single-layer construction with a weave pattern which repeats on 3 sheds.

Various weave patterns may be used in the respective plies, and it is preferred to use weave patterns which repeat on from two to six sheds in each layer in view of the machine limitations in the looms for weaving the fabric. The upper and lower plies may be connected together with binders which follow various different schemes of interweaving, but it is preferred to use an arrangement wherein the binders are buried within the respective upper and lower plies without substantial exposure of the binders to the outside surfaces of the multi-ply fabric.

The ovate cross-section of the lower warp substantially increases the tensile strength of the fabric in the machine direction by providing a greater warp-wise strength in the fabric by reason of the greater cross-sectional area of the bottom warps. By forming the fabric so that the major axis of the ovate cross-section is horizontal, the pressure on the binder against this warp is distributed over a larger area and thereby reduces the localized wear of the binder and thus prolongs the life of the fabric. Although the thickness of the warps in the vertical direction is not comparable to the width in the horizontal direction, it does not affect the wear characteristics since in any forming fabric the warps rarely wear through from the bottom because they are protected by the protruding bottom shutes. The major cause for discarding so-called "3-layer" prior art forming fabrics is their delamination due to binder failure or the shutes being worn out.

The use of the ovate warps provides the greater tensile strength without increasing the thickness of the lower ply. This thereby enhances the flexibility of the fabric as it travels over foils or table rolls in the forming section. Thus, the thinner fabric by reason of the reduced height of the lower warps renders the fabric much more flexible in the machine direction permitting "table activities" as it travels on the forming table to facilitate dispersion of the fibers more uniformly throughout the layer of pulp on the table, thereby producing a better quality of paper. While flexibility in the machine direction is desirable, it is desired to avoid substantial flexibility in the shute direction, so as to avoid "ridging" of the fabric during operation. For this reason, the use of a shute of circular cross-section in both plies is the preferred embodiment to maximize the shute-wise rigidity of the fabric. The top warps also are circular in cross-section to provide a balanced structure with the circular top shutes.

By incorporating in the upper and lower plies 23 and 31, warp yarns of approximately the same height, the total warp cross-sectional area of the top ply is approximately equal to that of the bottom ply. It is believed that the weave construction of the present invention avoids a cause for generation of internal stresses and strains within the body of the multi-ply fabric. In prior art fabrics where the warps in the lower ply of the fabric are of substantially greater diameter than the warps in the upper ply, the total warp cross-sectional area is substantially greater than that of the upper ply. Therefore, the modulus of elongation for the two different fabrics is different, and when the multi-ply fabric is trained around the guide rollers at the forming end of the paper making machine, the flexing of the multiple plies generates stresses and strains which permit a degree of relative longitudinal displacement between the upper and lower plies thereby affecting the binder shute yarns so as to increase the likelihood of premature failure due to internal shear of the binder yarns prior to the time when the fabric would otherwise be ready for replacement due to wear on the lower ply.

With the fabric of the present invention, the ovate warps, having less warp density than in the upper ply, contribute to an openness in the lower ply which reduces the water-entrainment characteristics of the fabric. The more open weave in the lower ply provides ample open interstices on the under face for applying suction to the underside of the upper ply through the lower ply. In this fashion, the efficiency of the water extraction from the pulp is enhanced without adversely affecting the surface density of the paper web formed on the fabric.

In providing a fabric of this character, the reduced caliper in the lower ply avoids the tendency in conventional three-layer forming of fabrics to carry along a substantial quantity of the water extracted from the pulp. It has been found that about 60% of the body of the conventional forming fabric is void space capable of carrying this extracted water. The present invention reduces the volume of this void space and facilitates the discharge of the water carried in the space. Furthermore, by using the ovate-shaped bottom warp, the total fabric caliper is reduced and therefore the total internal volume which may contain the void space is also reduced. This minimizes the water-carrying capability of the fabric.

It has been found that in a conventional forming section, the upper surface of the pulp exhibits a greater degree of dryness than the surface which confronts the wire at the exit end of the forming section. It has been determined that this variation in dryness between the opposite surfaces of the pulp layer can be attributed not only to the fact that the upper surface of the layer is exposed to the atmosphere, whereas the lower surface is engaged on the surface of the fabric, but also that the lower surface of the pulp layer attracts entrained water from the fabric by capilliary action. Such rewetting of the pulp layer is undesirable, not only because of the increased moisture gradient in the pulp layer, but also because the the increased moisture lowers the efficiency of the paper machine in the forming section. The present invention reduces the amount of entrained water in the forming fabric and thereby reduces the amount of undesirable rewetting of the web at the exit end of the forming section.

As illustrated in the drawings, the arrangement of the binder shutes in the fabric enables the fabric to flex around the guiding elements in the paper machine without subjecting the binder shutes to exessive wear. The binder shutes may therefore be smaller in diameter than both the shutes and the warps in the upper and lower plies, and do not project beyond the upper and lower surfaces of the fabric. Thus, the machine wear on the fabric is confined to the major components of the lower ply of the fabric and particularly the exposed shute yarns on the undersurface of the lower ply which are of greater diameter and resistant to greater wear than the binder yarns. The reduced number of ovate warp yarns in the lower ply of the fabric is selected to provide a resistance to elongation which is comparable to the resistance provided by the greater number of warp yarns in the upper ply of the fabric so that the modulus of the upper and lower fabrics in the machine direction is substantially equal and the internal stresses and strains which would otherwise occur within the multi-ply fabric are minimized.

The upper ply provides a smooth fabric face on the pulp side of the fabric, so as to produce a paper web having a dense and smooth surface texture. The lower ply, on the other hand, provides an open fabric having a high degree of porosity with substantial voids enabling the free moisture from the pulp to be extracted through the machine side of the fabric. The construction in each ply is selected to provide comparable moduli of extension in the warp direction, so as to minimize the strains in the multi-ply fabric when placed under stress.

While a particular embodiment of the present invention is illustrated and described, changes and modifications may be made therein and thereto within the scope of the following claims.

I claim:

1. A forming fabric for use at the wet end of a paper making machine to receive wet pulp and form the same into a consolidated web by affording discharge of the free water content of the wet pulp, comprising a multi-ply fabric having a width corresponding to the width of the paper making machine and a length in the form of a continuous loop corresponding to the length of the path of travel of the fabric through the paper machine, the uppermost ply of said multi-ply fabric comprising a self-sustaining weave construction having monofilament warp yarns of a given diameter interwoven with shute yarns in a weave pattern selected to produce the desired surface texture in the paper produced from the web formed on said fabric, the lowermost ply of said multi-ply fabric comprising a series of generally ovate warp yarns having a vertical dimension in the range of 1.0 to 1.5 times the diameter of the warp yarns of the uppermost ply, and shute yarns interwoven with said ovate warp yarns to produce a self-sustaining fabric construction which is characterized by a high degree of porosity without substantial voids, said ovate warp yarns in the lower ply having a horizontal width in the shute direction substantially greater than said vertical dimension, and binder shute yarns interconnecting the upper and lower plies, and being interwoven with the upper ply adjacent to a shute yarn of the upper ply at a point where said shute yarn passes over a warp yarn of said upper ply, and being interwoven with the lower ply adjacent a shute yarn of the lower ply at a point where said shute yarn of the lower ply passes under an ovate warp yarn of the lower ply.

2. A fabric according to claim 1 wherein each of the upper and lower plies has a single-layer weave construction.

3. A fabric according to claim 2 wherein each of said plies has a weave pattern which repeats on at least two sheds, and said binder shute yarn passes over at least one warp in the upper ply and at least under one warp in the lower ply.

4. A fabric according to claim 1 wherein said binder shute yarns are of equal or less diameter than the shute yarns in the upper ply, and said binder shute yarn passes over at least one warp yarn in the upper ply and under at least one warp yarn in the lower ply.

5. A wire former comprising a structural framework, a headbox for holding and dispensing the pulp slurry, a breast roll, a couch roll, a forming fabric belt extending endless between the breast roll and the couch roll in a straight run, drainage element and supporting structures underlying said straight runs comprising suction devices for extracting liquid from the slurry, means to apply suction pulses to the slurry 7 as it passes over the suction boxes to accelerate the removal of liquid, said forming fabric belt comprising a forming fabric according to claim 1.

* * * * *